US007086880B2

(12) United States Patent
Uchida

(10) Patent No.: US 7,086,880 B2
(45) Date of Patent: Aug. 8, 2006

(54) CONNECTOR WITH MOVABLE SHUTTERS

(75) Inventor: Shinji Uchida, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/784,304

(22) Filed: Feb. 24, 2004

(65) Prior Publication Data

US 2004/0229484 A1 Nov. 18, 2004

(30) Foreign Application Priority Data

Feb. 25, 2003 (JP) ..... 2003-048127

(51) Int. Cl.
*H01R 13/44* (2006.01)

(52) U.S. Cl. ..... 439/141

(58) Field of Classification Search ..... 439/140, 439/141, 607
See application file for complete search history.

(56) References Cited

U.S. PATENT DOCUMENTS

| | | | | |
|---|---|---|---|---|
| 3,167,373 A | | 1/1965 | Kostich | |
| 5,140,659 A | * | 8/1992 | Minds et al. | 385/66 |
| 5,167,516 A | | 12/1992 | Tan et al. | |
| 5,779,491 A | | 7/1998 | Nagano et al. | |
| 6,113,427 A | * | 9/2000 | Wu | 439/607 |
| 6,733,311 B1 | * | 5/2004 | Kameda | 439/140 |
| 2002/0123256 A1 | * | 9/2002 | Brickett | 439/140 |
| 2003/0013333 A1 | * | 1/2003 | Nagata | 439/141 |

FOREIGN PATENT DOCUMENTS

| | | |
|---|---|---|
| DE | 1202374 | 10/1965 |
| DE | 19809801 A1 | 9/1999 |
| FR | 2529396 | 12/1983 |
| JP | 2001-217039 A1 | 8/2001 |
| JP | 2001-351747 A1 | 12/2001 |
| JP | 2002-148483 A1 | 5/2002 |

* cited by examiner

*Primary Examiner*—Neil Abrams
(74) *Attorney, Agent, or Firm*—Rader, Fishman & Grauer PLLC

(57) ABSTRACT

A miniature receptacle having female contacts of the type which are not uncovered when a mating plug is not inserted is provided. A insulative socket housing (1) has an opening part (11) into which a plug having male contacts of the dual in-line type is inserted. A polarity of female contact (2) are arrayed in parallel on a pair of inner walls forming the opening part (11) to be opposed each other across the opening part (11). A shutter (3) is disposed within the opening part (11). The shutter shields a front face of the opening part (11) when the plug is removed and retracts towards a rear face of the opening part when the plug is inserted. A pair of compressed coil springs (5) are provided within the opening part (11) and give force to move the shutter (3).

5 Claims, 8 Drawing Sheets

CONNECTOR WITH MOVABLE SHUTTERS

CROSS-REFERENCE TO RELATED APPLICATIONS

This application is based upon and claims the benefit of priority from the prior Japanese Patent Application No. 2003-048127 filed on Feb. 25th in 2003, the entire contents of which is incorporated herein by reference.

FIELD OF THE INVENTION

The present invention relates to a socket (or a socket connector) for electric connection.

BACKGROUND OF THE INVENTION

Recently, miniature electronic devices such as cellular phones, micro video cameras, and portable information terminals can send and receive data to and from desk top personal computers. These miniature electronic devices are mounted with a socket which is used as an interface connector (or an I/O connector) for sending or receiving data.

In many cases, electronic devices with the socket use a connection base designated as a cradle (also referred to as a docking station) for sending or receiving data.

The cradle is mounted with a plug thereon and is connected to a cable by which the cradle and a desk top personal computer are connected to each other. On the other hand, an electronic device such as portable information terminals has a socket, and the socket disposed on the electronic device can be connected to the plug mounted on the cradle to secure high-speed data transfer between the electronic device and the desk top personal computer. One of the simplest forms of the cradle is a charger for cellular phones.

Additionally, when the socket disposed on the electronic device and the plug mounted on the cradle are not connected to each other, contacts provided within the socket is exposed unprotected. As a result, the contacts may be damaged by handling or dust.

To solve this problem, a socket having a cap or a cover for covering the socket so as to protect contacts arrayed in the socket from dust or handling has known.

Another dustproof connector by providing a shutter, instead of a cap or a cover for covering the socket has been provided (Japanese Unexamined Patent Publication No. 2001-351747). The connector disclosed in the Patent Document comprises a socket comprising a shutter which is closed to cover contacts disposed within the socket when a plug is not inserted into the socket. Thus, when a plug is not inserted into the socket, the contacts are protected from dust, whereas when a plug is inserted, the shutter is opened by pushing back the plug, thereby enabling the plug and the socket to come into contact with each other.

However, the cap or the cover should be removed from the socket having the cap or the cover, every time a plug is connected to the socket, making the connection more troublesome. Furthermore, there is a fear that the cap or the cover may be lost.

The plug mounted on a cradle is generally a multi-polar dual in-line plug having two rows of contacts. In the dual in-line plug, the contacts arrayed in two lines are surrounded by insulating fixed vertical walls protecting the contacts from being handled. Such a dual in-line plug is called four-wall shrouded, thereby having a large outer size.

However, electronic devices (micro video cameras, for example) to be connected to a cradle equipped with a dual in-line plug are increasingly being reduced in size. For this reason, it has been sought to miniaturize a dual in-line socket which can be connected to a dual in-line plug and can be attached to the aforementioned electronic devices.

However, the shutter provided within the socket of the dustproof multi-conductor connector disclosed in the aforementioned Patent Document is a folding retractable shutter composed of a plurality of shutter components, and the multi-conductor connector also has a locking mechanism. These features inevitably increase the outer size, making the socket unsuitable as a micro socket for use in an interface, which is now being sought.

In order to solve the aforementioned problems, the present invention has an object of providing a miniature multi-polar socket which can prevent contacts thereof from being exposed unprotected all the time.

SUMMARY OF THE INVENTION

In order to accomplish the object, the inventors of the present invention have invented the following new socket.

(1) A socket comprising: an insulating socket housing having an opening part through which a plug having dual in-line male contacts is inserted; female contacts which are arrayed in parallel on a pair of inner walls opposed to each other of the opening part and come into contact with the male contacts when the plug is inserted into the opening part; and an insulating shutter which closes a front face of the opening part when the plug is removed and retracts towards a rear face of the opening part by being pushed by the plug when the plug is inserted According to the invention described in (1), when the socket is not connected to a plug, the shutter closes the opening part of the socket, thereby protecting the female contacts from dust. On the other hand, when a plug is inserted into the socket, the shutter is retracted by being pushed back by the plug, making the male contacts of the plug come into contact with the female contacts of the socket.

(2) The socket according to (1), wherein the shutter is provided with an elastic member for moving the shutter towards the front face of the opening part when the plug is removed from the opening part.

According to the invention described in (2), when the plug inserted in the socket is removed, the force caused by the elastic member makes the shutter to close the front face of the opening part through which to insert the plug, thereby shutting off the contacts from outside. As a result, the female contacts can be protected from dust or handling. The aforementioned elastic member can be a compressed coil spring, for example.

(3) The socket according to (1) or (2), wherein legs of the female contacts is extended from the socket housing to be fixed on a printed circuit board According to the invention described in (3), the legs of each of the female contacts are welded by soldering or the like to the positioning pattern formed on the printed-circuit board, so as to mount the socket on the surface of the board.

(4) The socket according to any one of (1) to (3) further comprising: a shell for covering the socket housing; and a pair of soldering tabs for fixing the socket housing onto the printed-circuit board disposed on side parts of the shell According to the invention described in (4), the shell covering the socket housing can be fixed on the printed-circuit board by soldering to reinforce retention against the force caused by pulling out a plug.

(5) The socket of according to anyone of (1) to (3) further comprising: a shell for covering the socket housing, and the shell is formed of a metal thin plate and comprises a member for partially covering the front face of the opening part.

(6) The socket of according to (3): wherein the shell is formed of a metal thin plate and comprises a member for partially covering the front face of the opening part.

According to the invention described in (5) and (6), the shell formed of a metal thin plate covering the socket housing reinforces the socket housing structurally, and at the same time, shields the socket. The shell partially covers an inserting face (the front face) of the opening part formed in the socket through which a plug is inserted. Therefore, in the case where a mating plug having a plug shell covering a header part of the plug is used, when the mating plug is inserted into the socket, the plug shell and the shell of the socket come into partial contact each other, thereby making the plug and the socket integrally shielded.

(7) The socket according to any one of (1) to (6) to be used as an interface connector of a miniature electronic device (8) The socket according to any one of (1) to (7), wherein the female contacts are arrayed in parallel at regular intervals of 0.5 mm.

(9) A method for connecting a plug to the socket according to any one of claims 1 to 8, the plug comprising: an insulating plug housing having a frame part and a header part which is formed integrally with the frame part and is protruded from the frame part to be inserted into the socket; male contacts arrayed in parallel and pairs on the header part; and a plug shutter which covers the male contacts arrayed on the header part and can be stored in the frame part, and the method comprising: moving the plug shutter towards the rear face of the opening part along inner walls of the opening part when the plug is inserted into the opening part of the socket; and moving the plug shutter towards the front face of the opening part along the inner walls of the opening part when the plug is removed from the socket.

According to the invention described in (9), in the process of inserting the plug into the socket, the shutters are pushed backward to the opposite direction of inserting direction and make the male and female contacts exposed and come into contact with each other. In the process of removing the plug from the socket, the shutters move forward to the inserting face (front face) so as to cover the contacts, thereby protecting the contacts from dust, handling, or the like. Thus, unless the shutter of the socket or the plug shutter is intentionally pushed down, the female and male contacts are covered by the shutter or the plug shutter, respectively for protection.

(10) A plug capable of being connected to the socket according to any one of claims 1 to 8

The "insulating socket housing" can be assumed to be a socket housing made from a material electrically isolated, and to have a function of holding and protecting the female contacts with an electrically insulating member.

The "insulating socket housing" can be integrally molded with an electrically insulating synthetic resin member. After the socket housing is molded integrally using a synthetic resin member, the socket housing can be processed mechanically in parts. Furthermore, the socket housing can be made by cutting process.

The "female contacts" of the present invention can be so-called blade contacts having a rectangular horizontal cross section and no spring properties, and when the female contacts formed to have a width of 0.3 mm or so, the female contacts can be arrayed at a pitch of about 0.5 mm.

The number of poles of the female contacts to be arrayed is preferably 40 or more when the socket is used as an interface connector. In other words, as many as 20 female contacts can be arrayed in parallel on one side, and 13 female contacts can be arrayed in parallel on one side making 26 poles as a pair lines depending on the application of the socket connector.

The "insulating shutter" can be assumed to be a shutter made from a material electrically isolated, and not shorting when it contacts with the female contacts. The shutter can be assumed to cover the front face of the opening part so as to protect the female contacts from dust, except for the state where the socket is connected to a mating plug.

The shutter can be assumed to be moved towards the side of the front face of the opening part by a power caused by a pair of elastic members (compressed coil springs, for example) disposed at both flanks of a back face of the shutter. The shutter can be assumed to be slid into the opening part towards the rear face by being pushed by the inserted plug when the plug is inserted into the opening part.

The shell made of a metal thin plate having a thickness of about 0.2 mm reinforces the socket structurally by covering the insulating socket housing, and further fixing firmly the socket by being soldered to the printed-circuit board.

The socket with such a simple structure can be lowered in height, making it possible to be mounted on a miniature electronic device, thereby successfully miniaturizing a mating plug.

DETAILED DESCRIPTION OF THE PREFRRED EMBODIMENT

The embodiments of the present invention will be explained as follows based on the drawings.

Figure 1:
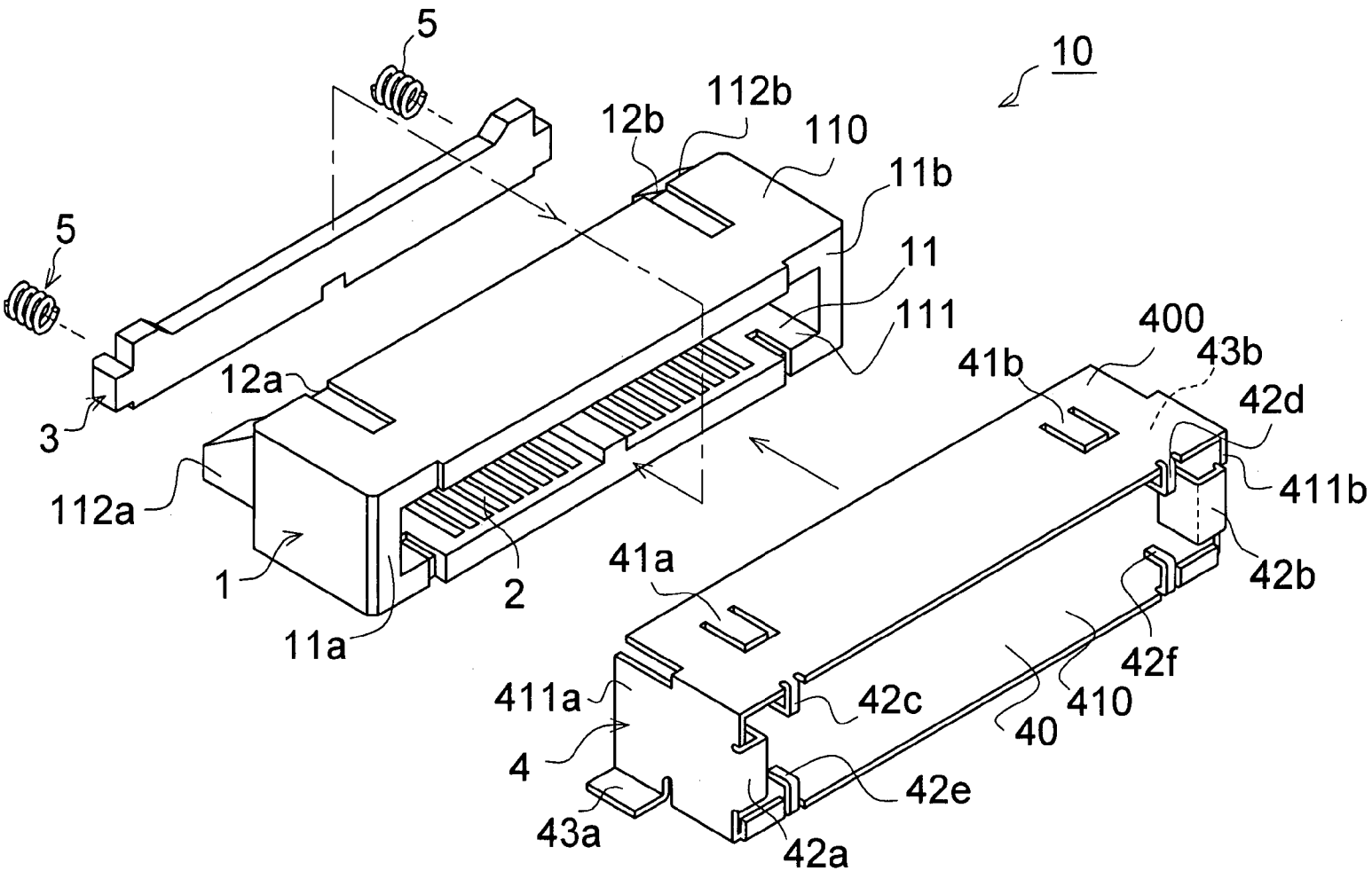
FIG. 1 is a disassembled perspective view of a socket of an embodiment of the present invention.

FIG. 1 is a disassembled perspective view showing the structure of a socket in an embodiment of the present invention. In the embodiment shown in FIG. 1, the socket 10 includes a socket housing 1, female contacts 2, a shutter 3, a shell 4, and compressed coil springs 5.

In the embodiment of FIG. 1, the insulating socket housing 1 includes an upper wall 110, a lower wall 111, and vertical frames 11*a* and 11*b*. The upper wall 110 and the face wall 111 are toward each other, and the vertical frame 11*a* and the vertical frame 11*b* are toward each other respectively, and there is an opening part 11 surrounded by the vertical frames 11*a* and 11*b*, the upper wall 110, and the lower wall 111. In other words, inner walls of the opening part 11 contain the vertical frames 11*a* and 11*b*, the upper face wall 110, and the lower face wall 111. And the female contacts 2 are arrayed in parallel on a pair of opposed inner walls of the opening part 11 making a pair of paralleled rows of the female contacts 2. To be more specific, the female contacts 2 are arranged in parallel on an inner side of the upper wall 10*a* and on an inner side of the lower wall 10*b* of the opening part 11.

The socket housing 1 is equipped with a pair of back walls 112*a* and 112*b* on a face (rear face) which is opposed to a face (front face) toward which a mating plug 100 (refer to FIG. 7) is inserted. The plug 100 is inserted into the opening part 11 of the socket housing 1 from the front face side. The opening part 11 keeps the shutter 3 inside via the compressed coil springs 5 which are the elastic members.

The socket housing 1 is laid in such a manner that the lower wall 111 is attached to a printed-circuit board, and the upper wall 110 is intended to be an upper side when the socket 10 is welded to the printed-circuit board. The upper wall 110 has a pair of latch grooves 12*a* and 12*b*. The latch grooves 12*a* and 12*b* lock latches 41*a* and 41*b* of the shell 4, which will be described later.

The shell 4 is formed by folding a thin metal plate in such a manner as to be a rectangular tube having a shell opening part 40 inside. The shell 4 includes an upper face wall 400 and a lower face wall 410 opposed to each other, and an outer wall 411*a* and 411*b* opposed to each other. The upper face wall 400 covers the upper wall 110 of the socket housing 1; the lower face wall 410 covers the lower wall 111; the outer wall 411*a* covers the vertical frame 11*a*; and the outer wall 411*b* covers the vertical frame 11*b* respectively.

The shell opening part 40 has a size sufficient to cover the socket housing 1, and the socket 10 is assembled so that the socket housing 1 is inserted within the shell opening 40 of the shell 4 from the front face side of the opening part 11. The upper face wall 400 of the shell 4 includes the pair latches 41*a* and 41*b* each formed by being cut out in the form of the letter U. The latches 41*a* and 41*b* are slightly bent inward.

On the front face of the shell 4 through which to insert the plug 100 are provided a pair of bezels 42*a* and 42*b* protruding from the outer walls 411*a* and 411*b* toward the shell opening part 40. The bezels 42*a* and 42*b* extend parallel to the front face of the shell opening part 40 from the outer walls 411*a* and 411*b* of the shell 4, and are bent towards the rear face opposed to the front face. The bezels 42*a* and 42*b* each have a L-shaped horizontal cross section (cross section taken along the line X—X of FIG. 2B) which is parallel to the upper face 400. The bezels 42*a* and 42*b* are assembled so as to be engaged with the vertical frames 11*a* and 11*b*, respectively, of the socket housing 1.

The upper face wall 400 of the shell 4 is provided with a pair of contact pieces 42*c* and 42*d* protruding towards the shell opening part 40. The contact pieces 42*c* and 42*d* extend parallel to the front face of the shell opening part 40 and further extend towards the rear face of the shell opening part 40. Similarly, the lower face wall 410 of the shell 4 is provided with a pair of contact pieces 42*e* and 42*f* protruding towards the shell opening part 40.

When the socket housing 1 and the shell 4 are combined, the contact pieces 42*c* and 42*d* lock the upper wall 110 of the socket housing 1, whereas the contact pieces 42*e* and 42*f* lock the lower wall 111 of the socket housing 1.

In addition, a tab 43*a* and a tab 43*b* are provided at the bottom parts of the opposed outer walls 411*a* and 411*b* protruding from the shell 4. The tabs 43*a* and 43*b* are solderable and fixed on the printed-circuit board. The tab 43*b* is not illustrated in FIG. 1.

Figure 2A:
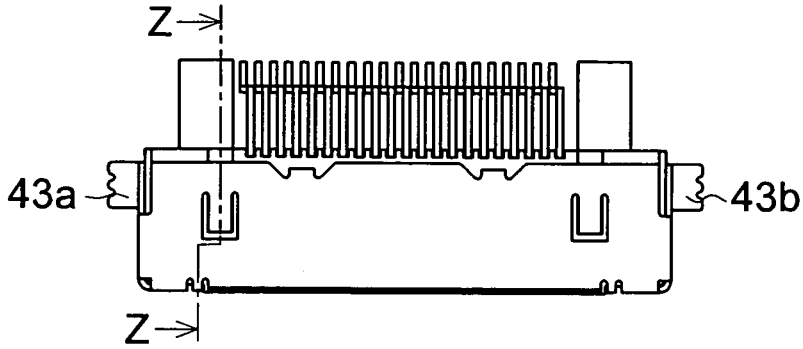
FIG. 2A is a plan view of the socket when assembled.
Figure 2B:
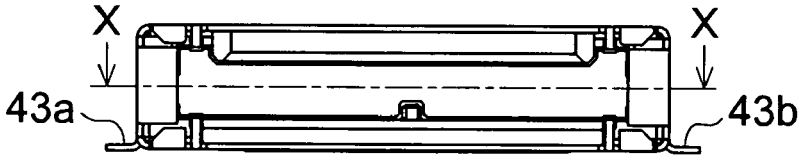
FIG. 2B is a front view of the socket when assembled.
Figure 2C:
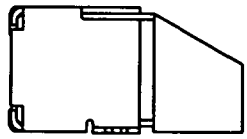
FIG. 2C is a side view of the socket when assembled.

The structure of the socket 10 in the present embodiment will be further explained as follows. FIG. 2A is a plan view of the socket 10 when assembled, FIG. 2B is the front view thereof, FIG. 2C is a side view thereof, and FIG. 2D is a cross sectional view taken along the line X—X of FIG. 2B.

Figure 2D:
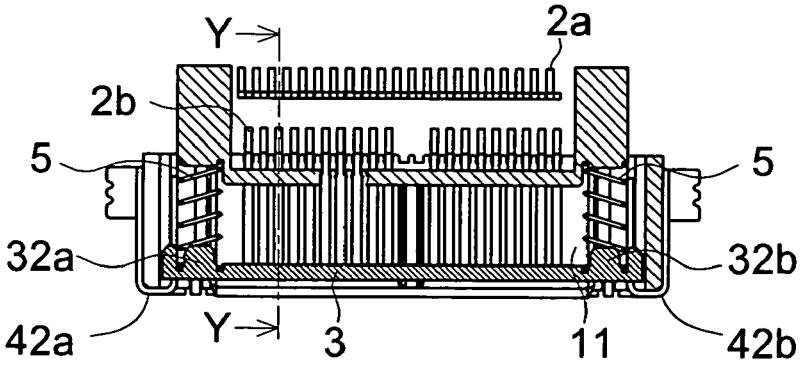
FIG. 2D is a cross sectional view of the socket taken along the line X—X of FIG. 2B.
Figure 3A:
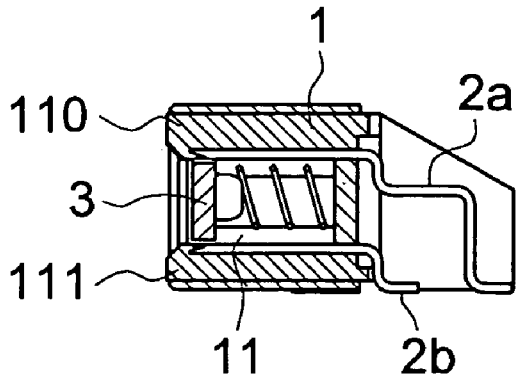
FIG. 3A is a cross sectional view of the socket taken along the line Y—Y of FIG. 2D.
Figure 3B:
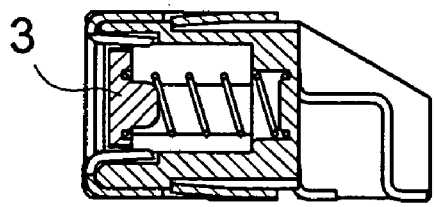
FIG. 3B is a cross sectional view of the socket taken along the line Z—Z of FIG. 2A.

FIG. 3A is a cross sectional view taken along the line Y—Y of FIG. 2D, and FIG. 3B is a cross sectional view taken along the line Z—Z of FIG. 2A.

As shown in FIG. 3A, the socket housing 1 has two kinds of female contacts; long contacts 2*a* are disposed on the upper wall 110 and short contacts 2*b* are disposed on the lower wall 111. The long contacts 2*a* and the short contacts 2*b* are opposed to each other with the opening part 11 therebetween. The long contacts 2*a* and the short contacts 2*b* form a multi-polar dual in-line type which includes two rows of paralleled arrayed contacts as mentioned above.

A long contact 2*a* includes a flat part in contact with the upper wall 110 and a leg extending from the socket housing 1. The leg is bent at right angles at two stages, so that a final end is bent to be parallel to the flat part and can be seated on a printed-circuit board (not illustrated in the Figs.). Similarly, a short contact 2*b* includes a flat part in contact with the lower wall 111 and a leg extending from the socket housing 1. The leg is bent in the direction orthogonal to the flat part, so that a final end is bent to be parallel to the flat part and can be seated on the unillustrated printed-circuit board.

The difference between the long contacts 2*a* and the short contacts 2*b* in this embodiment is the length of the extension from the socket housing 1 and the shape. The long contacts 2*a* are disposed to be the upper, and the short contacts 2*b* are disposed to be the lower in the socket 10. Since the present invention arranges the female contacts 2 at a small pitch of 0.5 mm or so, the female contacts 2 will be seated onto the surface of a printed-circuit board.

Next, the shutter 3 will be explained as follows. As shown in FIG. 2D, the insulating shutter 3 is held in the opening part 11 in a state of being movable within the opening part 11. The opening part 11 contains the pair compressed coil springs 5 which are elastic members. One end of each of the compressed coil springs 5 is locked to a pair of projections 32*a* or 32*b* provided on the shutter 3, whereas the other end of each of the compressed coil springs 5 is locked to the back wall 112*a* or 112*b* of the opening part.

By the aforementioned structure, the pair of compressed coil springs 5 gives a force to move the shutter 3 towards the front face of the opening part 11. In other words, the compressed coil springs 5 push the shutter 3 towards the front face of the opening part 11 when the plug 100 is not inserted, so the opening part 11 is shielded by the shutter 3. When the plug 100 is not inserted, an overrun of the shutter 3 is blocked by the pair of bezels 42*a* and 42*b*, making the shutter 3 to stay within the socket housing 1.

The pair of bezels 42*a* and 42*b* prevent the vertical frames 11*a* and 11*b* from being worn out or damaged by the insertion of a plug.

Figure 4:
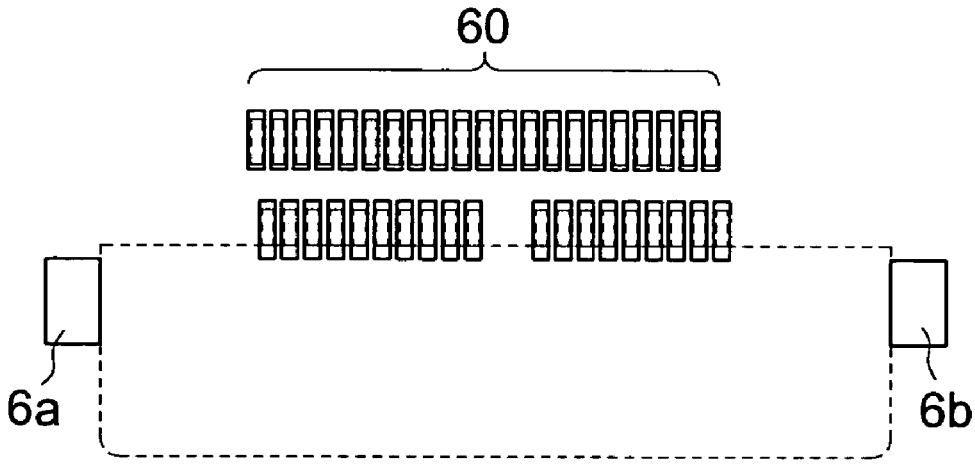
FIG. 4 is a pattern layout formed on a printed-circuit board on which the socket to be mounted.

In the aforementioned socket 10, the female contacts 2 are welded to the printed-circuit board, and the shell 4 covering the socket 10 is also fixed on the printed-circuit board. FIG. 4 is a pattern layout of the positioning pattern formed on a surface of the printed-circuit board on which the socket 10 is mounted.

As shown in FIG. 4, the printed-circuit board includes positioning patterns 6*a* and 6*b* to which the tabs 43*a* and 43*b* of the shell 4 are soldered, and a positioning pattern group 60 to which the legs of the female contacts 2 are soldered. The female contacts 2 are fixed on the positioning pattern group 60 and soldered, like a surface mounting device, to the printed-circuit board with which the socket 10 is intended to be mounted.

Figure 5:
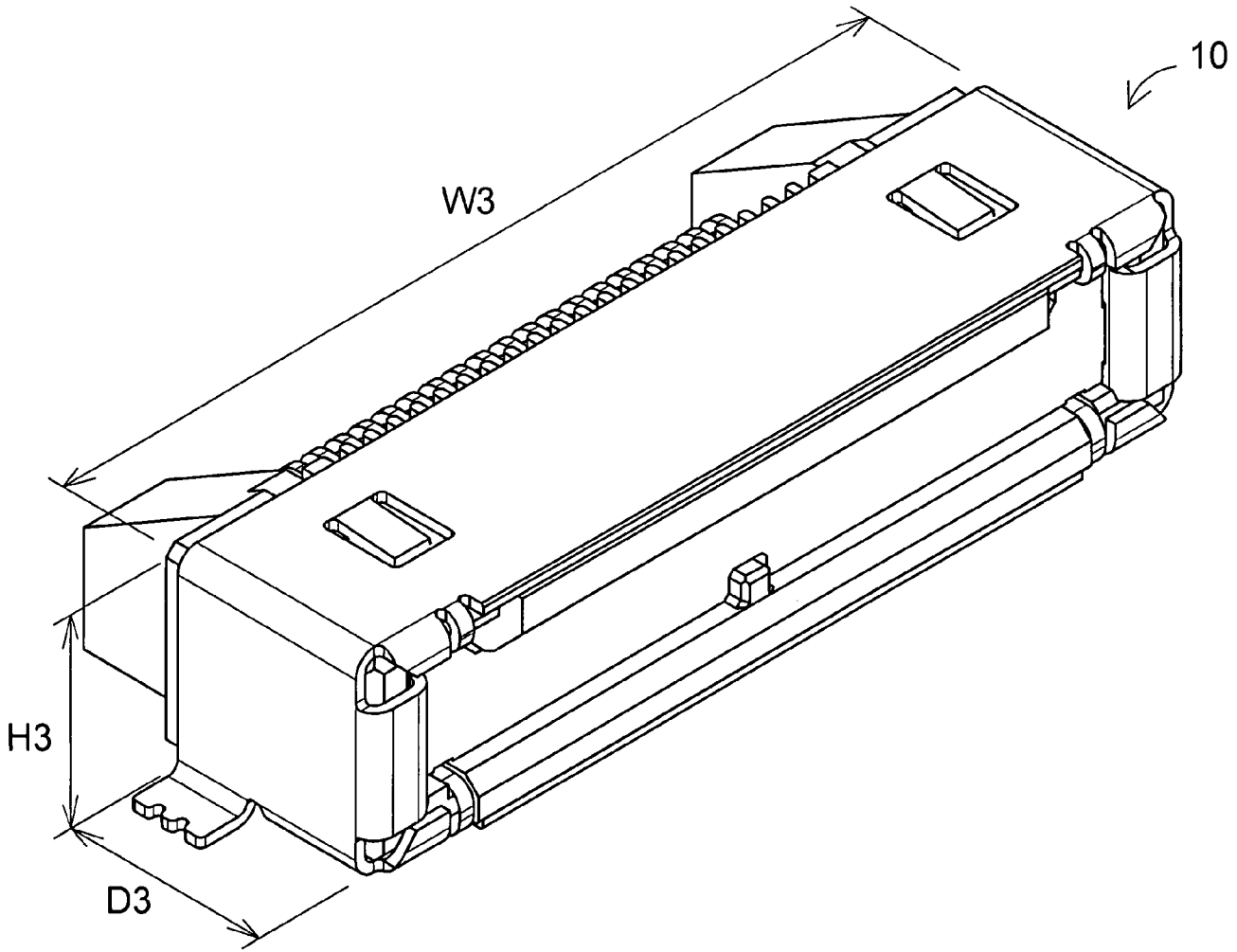
FIG. 5 is an external perspective view of the assembled socket, with the shutter covering the opening part.
Figure 6:
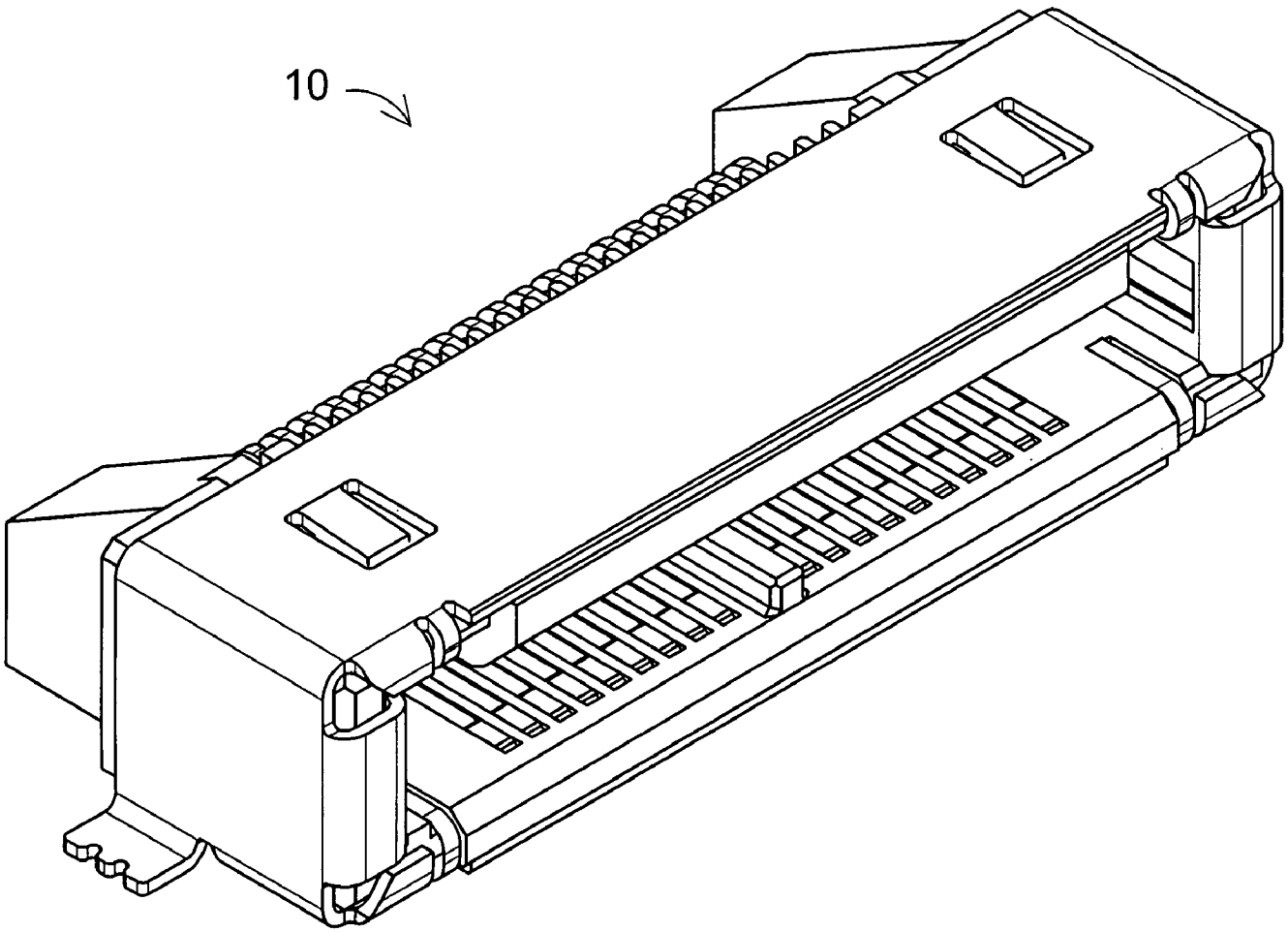
FIG. 6 is an external perspective view of the assembled socket, with the shutter open.

The following is a description of the effects of the present invention. FIG. 5 is an external appearance of the socket 10, showing the state where the shutter 3 shields the front face of the opening part 11. FIG. 6 is another external appearance of the socket 10, showing the state where the opening part 11 is not shielded by the shutter 3.

Figure 7:
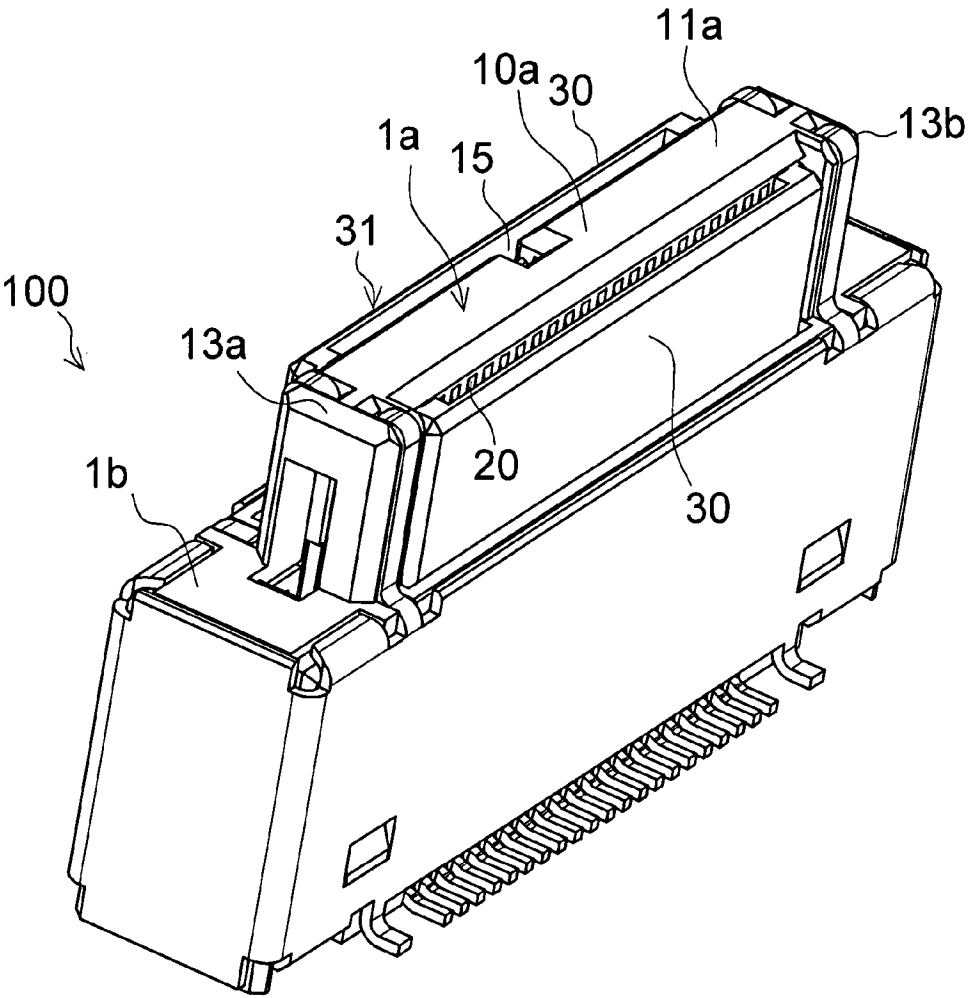
FIG. 7 is an external perspective view of a plug of an embodiment to be connected to the socket.

FIG. 7 is an external perspective view of the plug 100 of an embodiment which is connected to the socket 10 of FIG. 1. In FIG. 7, the plug 100 is provided with an insulating plug housing 10*a* and plural male contacts 20. The plug housing 10*a* includes a frame part 1*b*, and a header part 1*a* protruding from the frame part 1*b*. The header part 1*a* is formed integrally with the frame part 1*b* and provided with a plug shutter part 31 composed of a pair of insulating plug shutters 30 covering the male contacts 20.

The frame part 1*b* contains unillustrated compressed coil springs, and the compressed coil springs give force to raise the plug shutters 30 in the direction where the plug 100 is inserted into the socket 10 (upwards in FIG. 7). By this structure, as shown in FIG. 7, the plug shutter part 31 covers the male contacts 20, when the plug 100 is not inserted into the socket 10. On the other hand, when the plug 100 is inserted into the socket 10, the compressed coil springs contract to house the plug shutters 30 within the frame part 1*b*, making the male contacts 20 come into contact with the female contacts 2.

Figure 8:
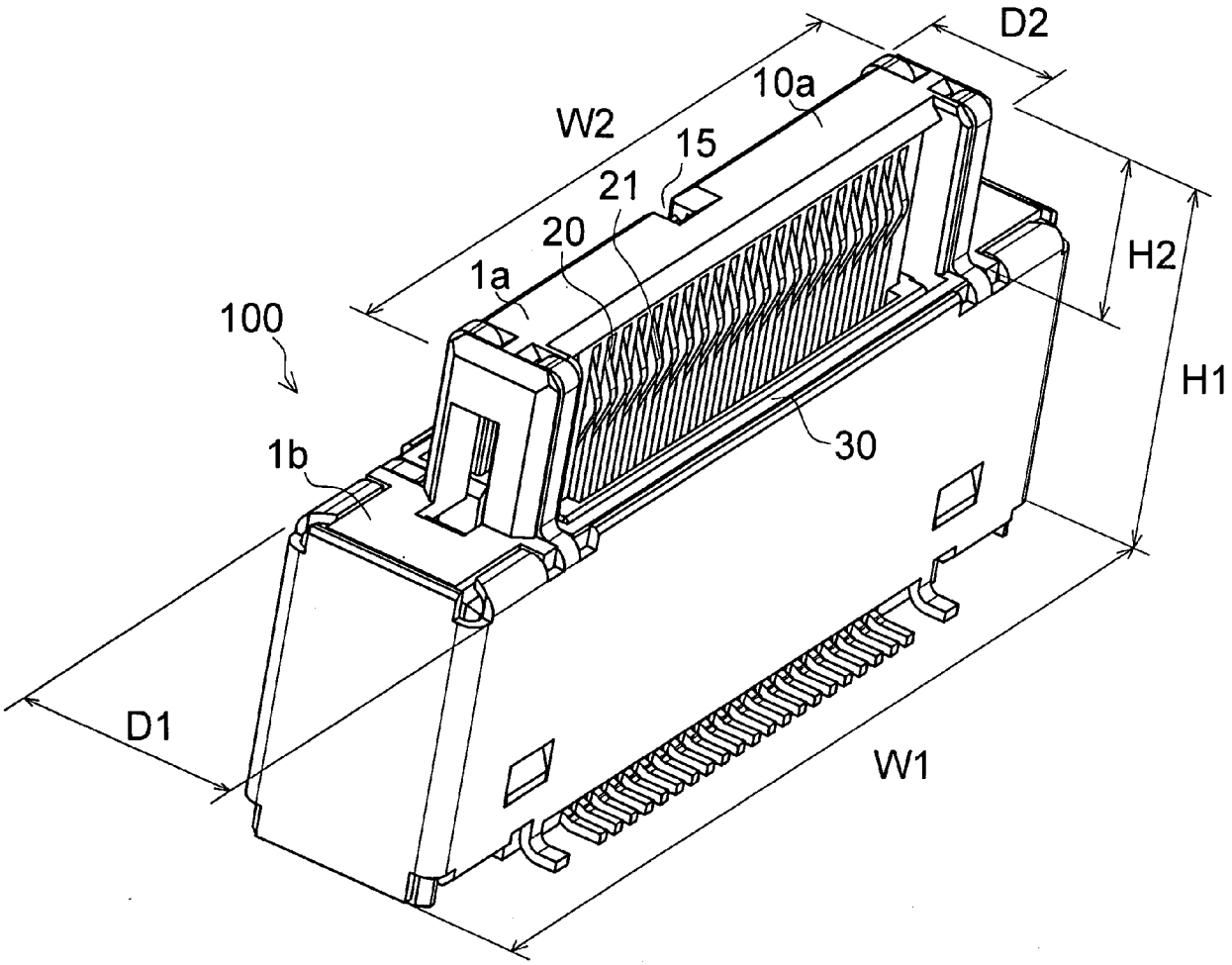
FIG. 8 is the plug shutter of the plug of FIG. 8 when buried in the frame part.

FIG. 8 shows the state where the plug shutters 30 are retracted and stored in the frame part 1*b*. In FIG. 8, the male contacts 20 are arrayed on the header part 1*a* in the form of a dual in-line type. A male contact 20 is a flexible leaf spring having flexible top part 21.

Figure 9:
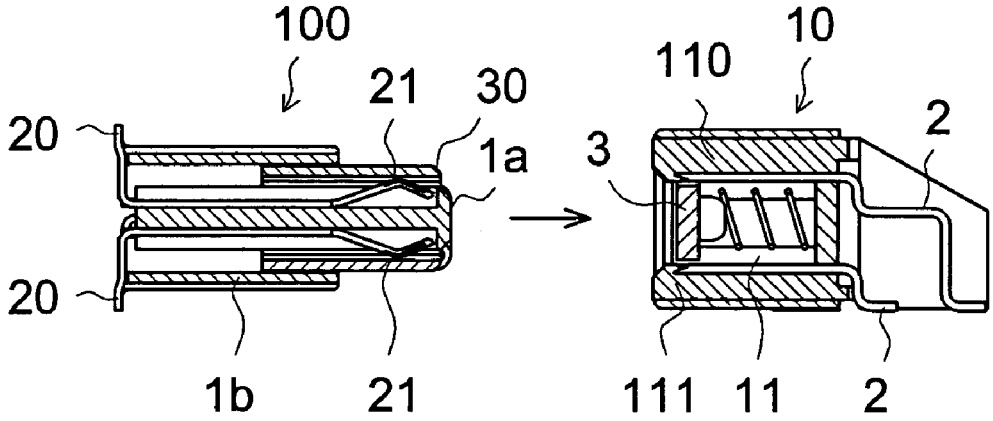
FIG. 9 is a view showing the socket and the plug opposed to each other.

FIG. 9 is a cross sectional view showing the case where the socket 10 and the plug 100 are disposed opposed to each other. In FIG. 9, when the plug 100 is not inserted into the socket 10, the shutter 3 closes the front face of the opening part 11 in the socket 10. On the other hand, in the plug 100, the plug shutters 30 cover the male contacts 20.

As shown in FIG. 9, the pair of male contacts 20 opposed to each other across a plate is held within the header part 1*a* in such a manner where the flexible top parts 21 of their flexible leaf springs are protruded towards opposite directions to each other.

When the header part 1*a* of the plug 100 is inserted into the opening part 11 of the socket 10 from the state of FIG. 9, the plug shutters 30 retract so as to be stored in the frame part 1*b* along the upper wall 110 and the lower wall 111 composing the opening part 11. On the other hand, the shutter 3 of the socket 10 is pushed by the header part 1*a* and retracted towards the rear face of the opening part 11.

When the header part 1*a* of the plug 100 is completely inserted into the opening part 11 of the socket 10, the female contacts 2 are exposed as shown in FIG. 6 in the socket 10. On the other hand, as shown in FIG. 8, in the plug 100 the male contacts 20 are exposed and set to come into contact with the female contacts 2.

Figure 10:
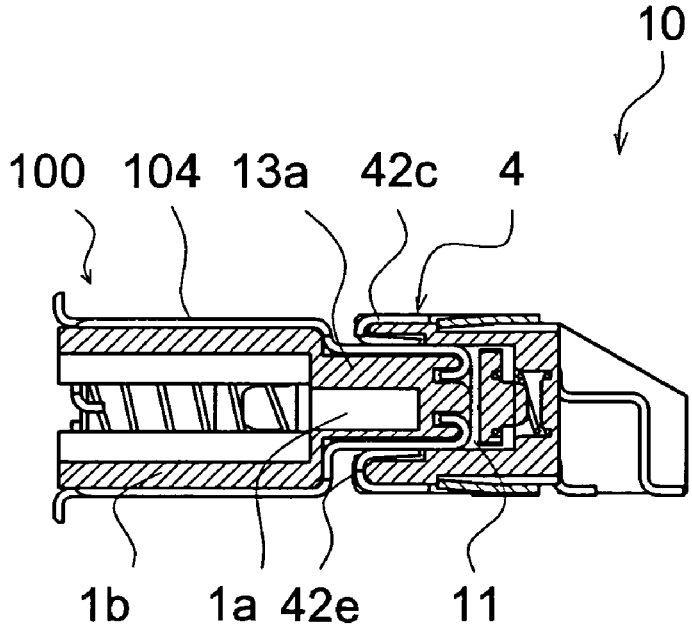
FIG. 10 is a cross sectional view showing the state where the header part of the plug is inserted into the opening part of the socket.

FIG. 10 is a cross sectional view in which the header part 1*a* of the plug 100 is inserted into the opening part 11 of the socket 10. FIG. 10 is the cross sectional view taken along the line Z—Z of FIG. 2A like FIG. 3B, and the plug 100 is cross-sectioned along a vertical support 13*a* of FIG. 7.

In FIG. 10, the frame part 1*b* of the plug housing 10*a* is covered with the metal plug shell 104 which is not illustrated in FIG. 7 nor FIG. 8. The plug shell 104 also partially covers the vertical supports 13*a* and 13*b*.

In FIG. 10, the plug shell 104 is in contact with the contact pieces 42*c* and 42*e* of the socket 10. Although it is not illustrated, the plug shell 104 is also in contact with the contact pieces 42*d* and 42*f* of the socket 10.

Thus, in the shell 4 of the socket 10, the contact pieces 42*c* to 42*f* partially cover the front face of the opening part 11. The header part 1*a*, the vertical supports 13*a* and 13*b* of the plug 100 on the other end are partially covered with the plug shell 104 made of a metal plate. When the plug 100 is inserted into the socket 10, the plug shell 104 and the shell 4 of the socket 10 partly contact each other, which makes the plug 100 and the socket 10 be shielded integrally.

In the embodiment shown in FIG. 8, the plug 100 has a lateral width W1 of 19.6 mm, a depth D1 of 4.1 mm, and a height H1 of 9.5 mm. The protruding header part 1*a* of the plug 100 has a lateral width W2 of 14.7 mm, a depth D2 of 2.4 mm, and a height H2 of 3.2 mm. The male contacts 20 have a pitch of 0.5 mm and 42 poles; however, two poles become unusable (not contactable) because of a key groove 15, so the substantial number of poles is 40.

On the other hand, in the embodiment shown in FIG. 5, the socket 10 has a lateral width W3 of 17.4 mm, a depth D3 of 4.7 mm, and a height H3 of 4.1 mm. The female contacts 2 (See FIG. 1) have a pitch of 0.5 mm and 42 poles; however, two poles become unusable (not contactable) because of a key, so the substantial number of poles is 40. Thus, the socket small in size and with multi poles is suitable as the interface connector for use in miniature electronic devices.

The socket of the present invention can protect the female contacts from dust because the front face of the opening part holding the female contacts inside is shielded by the shutter when the socket is not connected to a mating plug.

When the mating plug is connected to the socket, the shutter is pushed by the plug, making the male contacts of the plug come into contact with the female contacts of the socket.

Covering the male contacts of the dual in-line type from both sides and using a plug having a reciprocating thin plate shutter in combination with the socket of the present invention can provide dust-proof measures for both the plug and the socket.

What is claimed is:

1. A method for connecting a plug to a socket, the socket comprising:

an insulating socket housing having an opening part through which a plug having dual in-line male contacts is inserted;

female contacts which are arrayed in parallel on a pair of opposing inner walls of the opening part and come into contact with the male contacts when the plug is inserted into the opening part;

an insulating shutter which closes a front face of the opening part when the plug is removed and retracts towards a rear face of the opening part by being pushed by the plug when the plug is inserted for protecting the female contacts from dust; and a shell covering the socket housing: wherein the shutter is formed of a substantially flat board-like element disposed approximately perpendicular to the direction of the plug insertion; and wherein the shell comprises a pair of members formed on a pair of opposing edges for partially covering the front face of the opening part and for preventing the shutter from coming out from the socket housing, and the plug comprising:

an insulating plug housing having a frame part and a header part which is formed integrally with the frame part and is protruded from the frame part to be inserted into the socket;

male contacts arrayed in parallel and on a pair of outer walls on the header part; and a plug shutter which covers the male contacts arrayed on the header part and can be stored in the frame part, the method comprising:

moving the plug shutter towards the rear face of the opening part along inner walls of the opening part when the plug is inserted into the opening part of the socket; and moving the plug shutter towards the front face of the opening part along the inner walls of the opening part when the plug is removed from the socket.

2. A connector comprising:

a socket comprising an insulating socket housing having an opening part, female contacts which are arrayed in parallel on a pair of opposing inner walls of the opening part, an insulating shutter for closing a front face of the opening part, and a shell covering the socket housing; and a plug comprising an insulating plug housing having a frame part and a header part which is formed integrally with the frame part and protrudes from the frame part to be inserted into the opening part of the socket, male contacts arrayed in parallel on a pair of outer walls of the header part, and a plug shutter for covering the male contacts;

wherein each of the male contacts comes in contact with each of the female contacts by inserting the header part of the plug into the opening part of the socket from the front face towards a rear face opposing to the front face, wherein the shutter is formed of a substantially flat board and is disposed perpendicularly to the direction of the insertion, wherein the socket further comprises a pair of elastic members for moving the shutter towards the front face of the opening part when the plug is removed, wherein the shell has a pair of members formed on a pair of opposing edges for preventing the shutter from coming out from the socket housing, and wherein the shutter is moved towards the rear face of the opening part by being pushed by the tip of the header part to open the opening part, and a pair of opposing edges of the opening part push the plug shutter so that the plug shutter is slid so as to be stored in the frame part to expose the male contacts when the plug is inserted into the socket.

3. The connector according to claim 2, wherein legs of the female contacts are extended from the socket housing so as to be fixable to a printed circuit board.

4. The connector according to claim 2, wherein a pair of soldering tabs for fixing the socket housing to a printed circuit board, the tabs being disposed on side parts of the shell.

5. The connector according to claim 2, wherein the female contacts are arrayed in parallel at regular intervals of 0.5 mm.

* * * * *